US005219078A

United States Patent [19]

Hadden

[11] Patent Number: 5,219,078

[45] Date of Patent: Jun. 15, 1993

[54] MATERIAL SEPARATING AND SIZING APPARATUS WITH VIBRATING RODS AND METHOD

[75] Inventor: Robert J. Hadden, Middleboro, Mass.

[73] Assignee: The Read Corporation, Middleboro, Mass.

[21] Appl. No.: 834,641

[22] Filed: Feb. 12, 1992

Related U.S. Application Data

[63] Continuation of Ser. No. 625,865, Dec. 11, 1990, abandoned.

[51] Int. Cl.[5] ..... B07B 9/00

[52] U.S. Cl. ..... 209/234; 209/314; 209/315; 209/319; 209/393; 209/420

[58] Field of Search ..... 209/234, 311, 314, 315, 209/319, 393, 395, 400, 420, 674

[56] References Cited

U.S. PATENT DOCUMENTS

| | | | |
|---|---|---|---|
| D. 263,836 | 4/1982 | Read | D15/147 |
| 678,819 | 7/1901 | Watkins | 209/315 X |
| 760,590 | 5/1904 | Vodra | 209/393 |
| 886,247 | 4/1908 | Rechtenbach | 209/394 |
| 2,142,600 | 1/1939 | Bixby | 209/393 |
| 2,267,327 | 12/1941 | Ellen | 209/314 X |
| 3,221,877 | 12/1965 | De Koning | 209/314 |
| 4,197,194 | 4/1980 | Read | 209/325 |
| 4,237,000 | 12/1980 | Read | 209/319 |
| 4,256,572 | 3/1981 | Read | 209/257 |
| 4,361,240 | 11/1982 | Davis et al. | 209/674 |
| 4,693,379 | 9/1987 | Stehle | 209/674 |
| 4,956,078 | 9/1990 | Magerowski et al. | 209/315 X |

FOREIGN PATENT DOCUMENTS 2134415 8/1984 United Kingdom .

*Primary Examiner*—Andres Kashnikow
*Assistant Examiner*—Joseph A. Kaufman
*Attorney, Agent, or Firm*—Richard P. Crowley

[57] ABSTRACT

A material separating apparatus and method which comprises a frame of a pair of spaced apart generally downwardly sloping, upper and lower vibratory screening decks within the frame, the upper screening deck comprising a plurality of comb-like elements, which are generally parallel, straight finger elements removably extending from a transverse bracket support and onto which finger elements a feed material is discharged to be separated into a coarse material and a finer material. A lower deck comprises a plurality of comb-like elements having a plurality of transverse cross members and a plurality of downwardly extending, small diameter finger elements extending therefrom, the finger elements being of greater plurality and of smaller diameter than the finger elements of the upper screening assembly, and downwardly angled so as to provide for the separating and sizing of feed material falling from the upper screening deck onto the lower screening deck. The apparatus and method provide for the screening on the upper deck and screening and the sizing of material falling thereon. The separating apparatus has an eccentric rotating shaft secured to the upper and lower decks to impart vibratory motion thereon so that the free ends of the vibratory fingers vibrate in a generally vertical direction.

22 Claims, 4 Drawing Sheets

MATERIAL SEPARATING AND SIZING APPARATUS WITH VIBRATING RODS AND METHOD

This is a continuation of copending application Ser. No. 07/625,865 filed on Dec. 11, 1990, now abandoned.

BACKGROUND OF THE INVENTION

Soil and loam screening apparatus are known in which a screening apparatus includes a frame and a pair of sloping vibratory shaker screens supported within the frame. Generally the frame has a tall end and a short end joined by two sides and has funneling surfaces directed toward the upper shaker screen. Soil or other material to be screened is dumped onto the upper shaker screen, for example, from the shovel of a payloader, falls from the lower end of the upper shaker screen outside of the frame, while the material which is smaller than the screen of the upper frame passes through the upper shaker screen to a lower vibratory screen of smaller opening dimensions which permits coarser material to be discharged at the one short end of the frame and finer material to pass through the lower shaker screen either onto a conveyor belt or within the frame for later retrieval. Such vibratory loam and soil material screening apparatuses are described in U.S. Pat. Nos. 4,197,194, issued April 8, 1980; 4,237,000, issued Dec. 2, 1980; 4,256,572, issued Mar. 17, 1981; and Des. 263,836, issued Apr. 13, 1982 hereby incorporated by reference and which apparatuses are known in the industry as Read Screen-All® soil separating apparatuses (Read Screen-All® is the registered trademark of James L. Read, Middleboro, Mass.).

Generally, the pair of shaker screen assemblies in the above-described loam and soil material separating apparatus is secured compression springs and the shaker assembly bounces on the springs in a rotary-type movement. Movement is imparted by the operation of an off balance shaft mechanism secured to the upper and lower shaker mechanisms generally by an off balance flywheel secured to each end of a shaft, which shaft is driven by a hydraulic motor. Generally, the upper shaker screen is composed of a woven wire assembly of typically large diameter wire in order to withstand the impact of soil or another material dumped by a payloader directly onto the upper screen assembly, and which soil material may includes large rocks or other heavy debris, while the screen of the lower shaker assembly is usually of smaller diameter wire and having smaller openings with the diameter of the woven screen and openings selected for the particular separation desired.

While loam and soil material are generally quickly and efficiently separated in the above-described separating apparatus, where the feed material to the apparatus comprises wide a variety of material such as that found in dumps, which would include leaves, paper bags, sticks, as well as sand, soil, rocks, twigs, cans, bottles, domestic and industrial garbage and trash, and construction site debris, the separation of such material becomes more difficult, for example, plastic bags and long twigs tend to become stuck in the upper or lower woven screen assemblies, and thus must be periodically removed to maintain the efficiency of the separation.

There are a wide variety of vibratory screening apparatus employed to screen various, disparate feed-type materials, and which vibratory screening apparatus rather than using woven screens, comprise comb or finger-like members composed of rods arranged in a series of decks over which the feed material is passed to be separated. Typically, the screening decks are arranged in a shingle array fashion, with each deck generally horizontally or slightly downwardly tilted from the horizontal and having a plurality of array of finger or rod-like members projecting from a transverse frame, so as to provide for the desired separation.

One vibratory screening apparatus is described for example in U.K. Patent GB 2 134 415B published Aug. 15, 1984, which describes a screening apparatus with a plurality of replaceable screening decks arranged transversely with finger-like members defining spaces therebetween and which spaces diverge in a direction from the transverse screen portion of the apparatus. In addition, a similar screening apparatus is described in U.S. Pat. No. 4,693,379, issued Sep. 15, 1987, which apparatus includes a plurality of inclined, open ended bars capable of oscillatory movement and formed in a stepped arrangement with one screen located behind the other to provide for the separation of a wide variety of materials. The screening apparatus employs bars of circular, rectangular, prismatic or T-shape profile cross section and zigzag shaped bars for example to prevent the passage of paper sheets through the bars.

It is desirable to provide for the more efficient and effective separation and also sizing of a wide variety of material in a screening apparatus and method so as to provide for both screening and sizing.

SUMMARY OF THE INVENTION

The present invention relates to a material separation apparatus and method, and particularly to a material sizing and separating apparatus and method employing angled upper and lower vibratory fingers, the upper deck comprised of straight, separating rods and the lower deck comprised of angled separating and sizing rods.

The invention comprises a soil separating apparatus and method, which constitutes an improvement on the Read Screen-All® separating apparatus, which comprises a frame, generally rectangular to support an upper and lower screening assemblies, the frame generally having a one tall end and an other short end and sides joining the ends adapted to support a pair of angled, vibratory screening assemblies therein, the one end of the frame and the width sufficiently high and sufficiently wide to permit the discharge within the frame of feed material from a soil carrying apparatus, such as a bucket of a payloader, into the tall end of the frame. The apparatus includes a vibratory screening assembly comprising a downwardly sloping from the tall to the short end of the frame of an upper and spaced apart lower screening apparatus so as to separate feed material discharged into the frame into a coarse material which is discharged at the other short end of the frame, and a finer material which passes through the upper and lower screening assemblies, and which is within the frame and is removed from the frame by a payloader or by conveyor means. The apparatus includes a means to vibrate the upper and lower screening assemblies and generally as in the Screen-All® apparatus would include an hydraulic motor attached to a rotary shaft having an eccentric flywheel with the upper and lower assemblies mounted on springs so as to provide for a vibratory or shaking movement of the upper and lower screen assemblies.

The upper screening deck assembly may comprise for example a large diameter, open weave type woven screen as is presently employed in a Screen-All® apparatus with the openings so selected so as to provide for the type of feed material to be separated or more preferably, comprise for example an upper deck with a plurality of replaceable screening decks arranged in a shingle-type array each of which decks comprises a cross frame member with a plurality of generally uniformly spaced apart cylindrical, rod or finger elements secured at one end to the frame member, adapted for vibratory motion at the free end thereof in a vertical direction. The rod elements preferably are straight, but may be angled as in the lower deck assembly or differently angled and arranged. The rod members define spaces therebetween for the separation as desired of the feed material into a coarse material and a finer material, the free ends of the rod-like members extending over the secured section of the next lower deck with the decks angling slightly downward so that the transport of the feed material moves from the tall end of the frame toward the other, short end of the frame, that is, the material transport path is downwardly so that coarse material is discharged out of the frame at the short end.

Generally, the conical, rod-like members are of sufficient size, that is, of a diameter and strength to withstand the heavy debris and feed material dumped onto the rod-like members. Typically, the rods may for example have a diameter of about ¼ up 1½ inches (6.4 to 38.1 mm) in diameter and be spaced apart for example from about ½ to 8 inches (12.7 to 203.2 mm) and extend from about 12 to 36 inches (304.8 to 914.4 mm) in length. The number of rods and the number of decks of course may vary as desired depending upon the type of material to be separated by the machine, but generally would comprise from at least two, and typically, three to six upper overlapping decks. Generally the rods of the upper screening deck may vary in length and generally are longer than the rods of the lower deck and for example may extend from about 8 to 24 inches (203.2 to 609.6 mm)).

Importantly, the rods on the upper deck mounted on a cross frame or bracket, transverse member in an individual manner, that is, one end of the rod is threaded or tapped into a cross frame support with a bracket, the bracket extending transversely across substantially the width of the frame, and which is vibrated by the rotating shaft to provide vibratory motion to the free end of the rod. The upper rods are individually mounted in order to permit easy replacement of individual rods, rather than of the entire deck assembly, since damage is more likely to occur in the upper rods because of the impact and greater loads imposed on the upper deck. In contrast, the rods of the lower deck are generally greater in number, of smaller diameter and more closely spaced together to perform a different function, so that such rods are not being subject to the higher impact and debris from the feed material, are generally not individually mounted, but securely clamped or mounted on frames so that the frames may be replaced as desired; however, the lower deck rods may also be individually mounted and replaceable.

The lower screening and sizing deck assembly comprises a plurality of downwardly sloping, overlapping, shingled array comb-type elements having a plurality of generally uniformly spaced apart rod or finger elements having a one end and the another end with the rod element secured at the one end to a transverse frame or crib bar and the other end free for vibration. The finger elements are generally uniformly spaced apart in and on the same plane. The free end of the elements extend downwardly at a slight angle overlapping in a shingle arrangement the next lower comb element, e.g. 1 to 4 inches (25.4 to 101.6 mm). The rod elements generally are uniformly angled at defined uniform distances along the length of the rod element, that is, in a generally zigzag, uniform, angled manner so that the angled rod elements may both separate and size the finer material falling on the lower deck from the upper deck to permit discharging of the coarse material toward the one end of the frame from the upper surface of the angled rod elements and to permit sized and separated finer material to pass through and into the inside of the frame.

The length, width, angles and spacing of the rod elements of the lower deck may vary as desired; however, for example, the rod elements generally extend from about 6 to 18 inches (152.4 to 457.2 mm) in length, while the selection of smaller diameter rod wire would decrease the length and larger diameter rod wire would lead to an increase in length. One end of the rod elements from the lower deck is secured in deck fashion, that is, crimped within a metal plate folded over in a U-shape to form single or multiple transverse frame members for the rod elements, generally with replacement of the rod elements after use in a deck-by-deck or comb-by-comb manner or individually.

Typically, the rod diameter in the lower deck would range from about 0.157 to 0.236 inches (4 to 6 mm) and with the opening between the rods ranging from about 0.197 to 1.57 inches (5 to 40 mm), depending upon the wire diameter. For example, with a typical wire diameter of 0.157 inches (4 mm) the aperture would range from 0.197 to 0.354 inches (5 to 9 mm). At 0.197 inches (5 mm) the aperture would be 0.1393 to 0.748 inches (10 to 19 mm) and at 0.236 inches (6 mm) the aperture would be 0.787 to 1.57 inches (20 to 40 mm). The number of decks in the upper and lower may vary illustratively where there are three overlapping, shingled decks as the upper screening assembly, then the lower screening and sizing assembly would have about 5 to 8 decks in a chair or step-like arrangement angled downwardly. The motion of the shaker head in the screening apparatus translates energy directly to the cross frame members of the upper and lower deck to provide vibration for example, in a Screen-All® device, at 1200 rpms, hut may vary from 500 to 1500 rpms as desired with generally the free end of the rods moving from 1/8 to 2½ inches (3.18 to 63.5 mm) in a vertical plane of vibration. The shingled array of the upper and lower decks may vary, but generally it is at an angle of about 0° to 15°, e.g. 3° to 10°, sloping downwardly toward the short end of the frame. The sloped angle cf the deck is related to the rate in which the desired material is openly transported directly from the tall to the short end so that the angle of the decks control the rate of material flow across the fingers and down the shingled or chaired steps of the vibrating rods. Usually, the rods are positioned in a uniform plane, that is, are not offset, for each deck, the free ends of the rods of one deck slightly overlying the secured ends of the rods of the other deck.

In order to provide both a separating and sizing operation, the rods of the lower deck must be periodically and generally uniformly angled along the length. The angling of the rod breaks up the continuous open space and thereby provides the separation and sizing of the finer material falling thereon. The aperture between the individual rod elements, that is, the opening, provides for a desired separation, while the length of the bent section in the rod elements provides for sizing. For example, the angling of the rod breaks up the length of the rod, for example, a rod of 12 inches (304.8 mm) having four sections of three inches (76.2 mm) would provide for the largest piece to fall through of only three inches in length and the space of the opening, for example, one-half inch in separation. Therefore, an elongated stick or paper bag may in fact pass through the vibrating large diameter rod elements, but because of the sizing effect of the angled rod elements of the lower deck, sticks, dinner plates and plastic bags would then be rejected and pass with the coarse material. Thus, the angled rods of the lower deck provide both a sizing and separating operation which is not provided by the vibrating rods or screens of the upper deck.

The number and the angle of the bends in the rods and the number of angles in the length of a rod may vary depending on the type of sizing desired. Generally, the angle of the rod is bent from say 0° to 15° for example uniformly three to four times along the length of the rod or as much as one bend per for two inches of rod length. The quantity and size of the bend in the rods is a factor determined by the product being screened and the sizing desired. The employment of the straight rods and the upper deck is advantageous in that plastic sheet-type material, such as plastic grocery bags and such, slide on the rounded surface of the rods downwardly toward the short end of the frame and therefore are not retained on the upper deck as generally is the case where a closely woven screen or rods with periodic transverse elements are employed. Therefore, the upper deck provides for the movement of the lighter plastic bags and plastic sheeting toward the short end of the machine, while the lower deck with the angled rods provides for separating and sizing those materials that pass through the straight rods of the upper deck. If desired, both the upper and lower decks may be composed of angled rod elements.

The upper deck does in a sense size the material as well as separate the material. It sizes the material for the bottom deck. To perform efficiently, the bottom or lower deck must receive proper size and volume of material from the upper deck. This is controlled by the selected spacing or aperture of the upper deck. The lower or bottom deck sizing is what produces the desired separated and sized finished product; however, the top deck directly influences how the bottom deck performs.

In operation, the vibration of the free end of the small diameter rods on the lower deck provides for vibratory, generally vertical up and down motion. For example, with feed material having compost, leaves and small organic material, the fingers moving up and down, strike and lift up the lightweight organic material or leaf matter, flips the material and permits the smaller, heavier material in the feed material to pass through the aperture and opening and therefore to be separated and sized by the lower deck and permitting the organic material and leaves to move downwardly to the short end of the frame. Thus, the combination of vibrating rods or screen in an upper deck and bent or angled smaller diameter vibrating rods in a lower, spaced apart deck provide a unique combination for both separating and sizing and to permit the feed material to be very diverse in nature.

In operation, the feed material to be separated into a coarse material and a finer material is discharged onto the upper surface of the upper deck of the vibrating rods or screen and coarser material which is unable to pass through the opening of the vibrating rods or woven screen moves downwardly and is discharged outside of the frame toward the short end. Finer material falls through the opening of the woven screen or vibrating upper rods of the upper deck and onto the vibrating, angled rods of the lower screen, separating and sizing the material falling onto the upper surface of the lower vibrating, angled rods and discharging material which is unable to pass the opening and sizing toward the short end of the frame into the coarse material and permitting the finer separated and sized material to pass through the angled, vibrating rods.

The invention will be described for the purposes of illustration only in connection with certain illustrated embodiments; however, it is recognized that those persons skilled in the art may make various modifications, changes, improvements and additions to the illustrated embodiments all falling within the spirit and scope of the invention.

DESCRIPTION OF THE EMBODIMENTS

Figure 1:
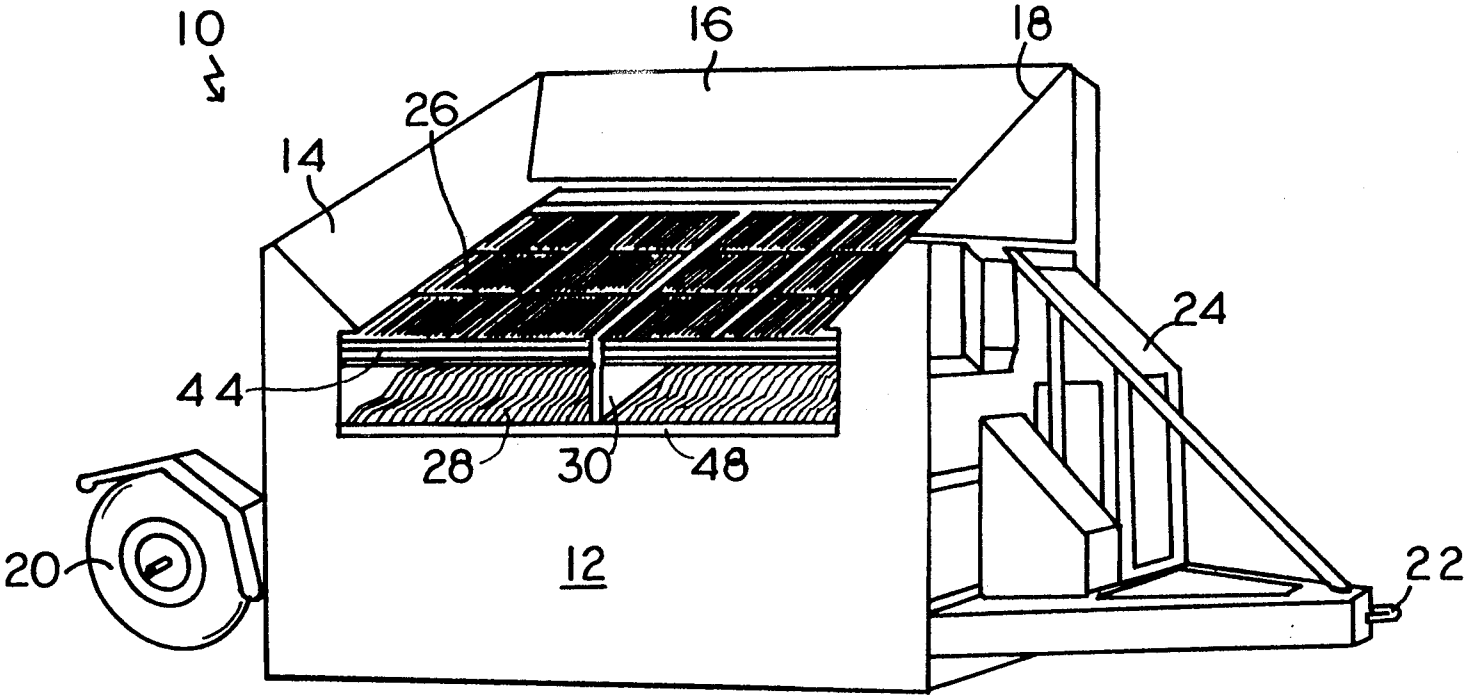
FIG. 1 is a perspective view from above of a material separating apparatus of the invention.

FIG. 1 is a perspective view of the separating-sizing apparatus 10 having a frame 12 and angled side funneling surfaces 14, 16 and 18 to direct material to be separated onto the angled top deck 26 spaced apart from an angled lower deck 28 with a stabilizing center plate 30 extending from the tall to the short end of the frame 12. The apparatus 10 is a portable, towable apparatus having a pair of wheels (one shown 20) for road transportation of the apparatus 10 with the wheels 20 movable relative to the frame 12, while at the one end there is a tow bar and hitch 22 for towing the apparatus 10 and a hydraulic motor within a housing 24 to provide a rotary or vibrating motion to the upper and lower decks 26 and 28.

Figure 2:
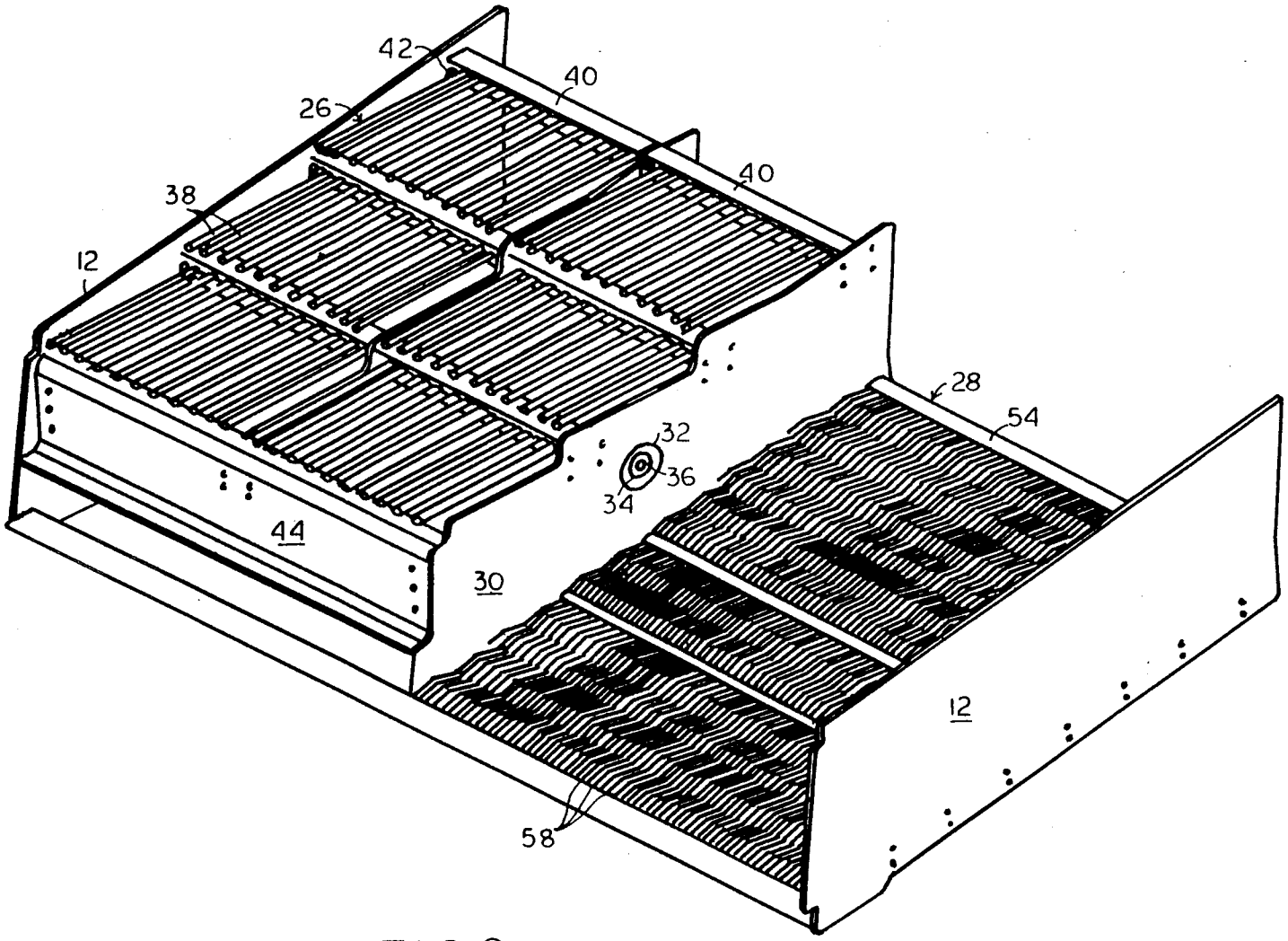
FIG. 2 is an enlarged, partially cutaway view of the upper and lower decks of the apparatus of FIG. 1.

FIG. 2 is an enlarged, cutaway view of the apparatus 10 illustrating more particularly the upper deck 26 and lower deck 28. The center plate 30 has a shaft housing 32 containing a rotary shaft 34 passing through the center plate and centrally mounted on a bearing 36 at each end of the frame, the rotary shaft driven by a hydraulic motor 24 to impart a vibrating, rotating motion to the upper and lower decks 26 and 28.

Figure 3:
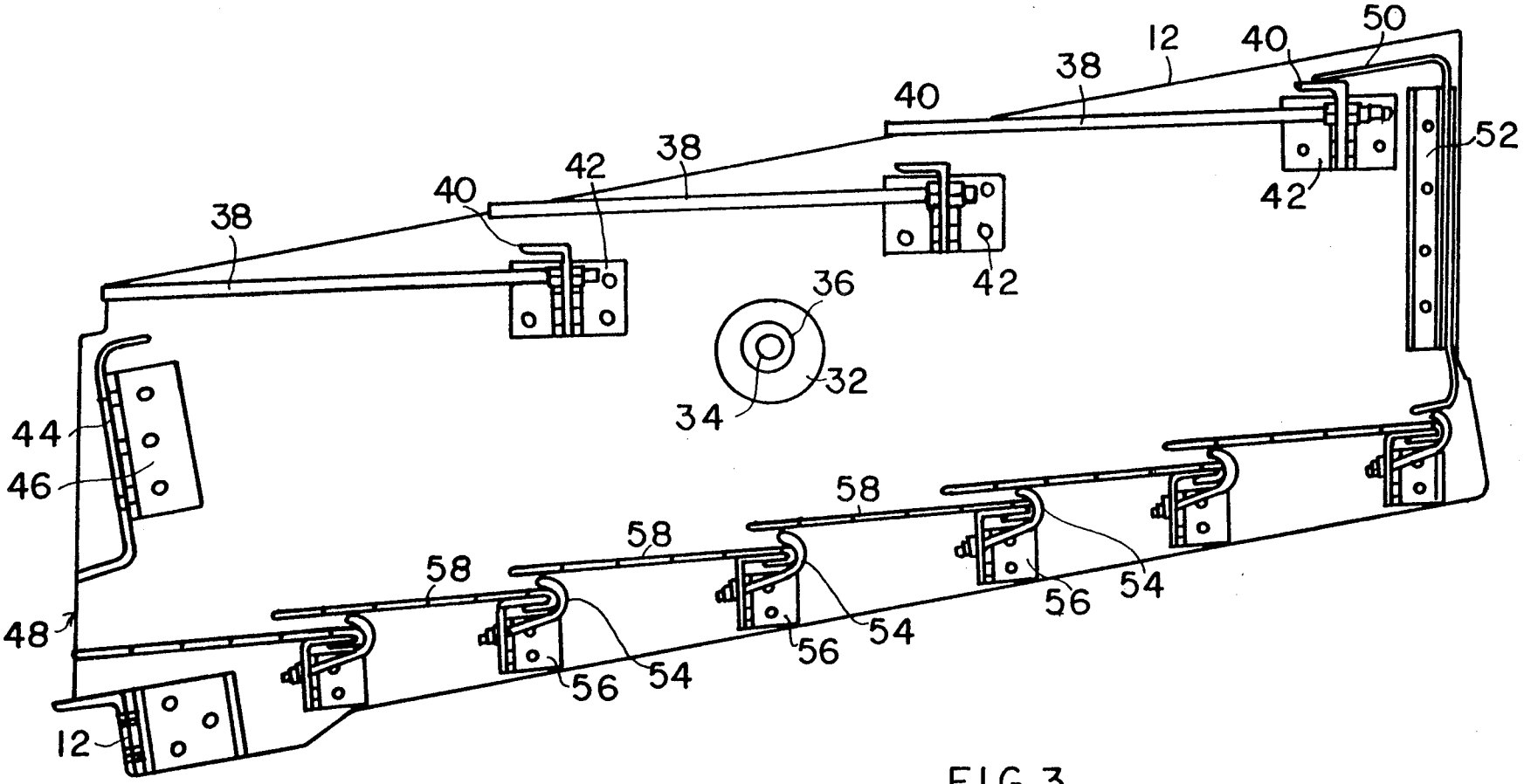
FIG. 3 is an enlarged, fragmentary, side, sectional view of the upper and lower shaker decks of the material separating apparatus of FIG. 1.

With reference to both FIG. 2 and FIG. 3, the upper deck 26 has a pair of transverse brackets 40 with end mountings 42 secured to the frame 12 and center plate 30. The brackets 40 have a plurality of uniformly spaced apart cylinder rods or fingers 38 threadably secured at the one end to the bracket 40 with the one end free to vibrate in a vertical movement on vibration of the upper deck 26. An upper material-directing, transverse solid plate 50 (not shown in FIG. 2) extending at a slight downward angle in the horizontal plane is secured to frame 12 by mounting 52 to direct material to be separated onto the first upper level of the three comb-like rod elements 38 of the upper deck 26 and extends at the one end over the first bracket 40. Brackets 40 may be enlarged and reversed to eliminate plate 50 and yet serve the function as plate 50. Bracket 40 also protects the fastening arrangement nuts and threaded end of rods secured by nuts from the materials discharged onto the upper deck. A lower material-directing plate 44 is secured by end mounting 46 to frame 12 and has a one upper end curved inwardly and extending just beneath the free end of the finger 38 of the last comb-like rods of the upper deck 26 to receive coarse material from the upper deck 26. The plate 44 extends generally vertically and has another lower end curved outwardly to direct the discharge of coarse material to the lower, short end and outside of apparatus 10. The lower, curved end provides a lateral opening 48 above the lower deck 28 for the discharge of coarse material from the opening 48 by the separation of coarse material by the lower deck 28. As illustrated, the rods 38 are 26 inches (660.4 mm) in length and spaced about 2 inches (50.8 mm) apart and have a rod diameter of three-quarters of an inch (19.1 mm).

The lower deck 28 has a series of six, slightly angled downward 58 comb-like elements each having a transverse lower C-type clamping bracket 54 with the ends secured by end mountings 56. The clamp bracket 54 secures in a clamping arrangement a plurality of uniformly spaced apart, small diameter, zigzag-shaped, cylindrical rods or fingers 58 with the one secured end of the fingers 58 bent and secured to the bracket 54 and the other free end extending slightly over the bracket 54 of the lower comb-like element in a shingled manner and free to vibrate in a vertical manner to separate and size coarse material to be separated and sized following through the upper deck 26 onto the surface of the fingers 58 of the lower deck 28. As illustrated, the upper fingers 38 may be individually replaced, while the lower fingers 58 are replaced by removing sections of the comb-like elements, typically removing the transverse row of the fingers 38 with bracket 54.

Figure 4:
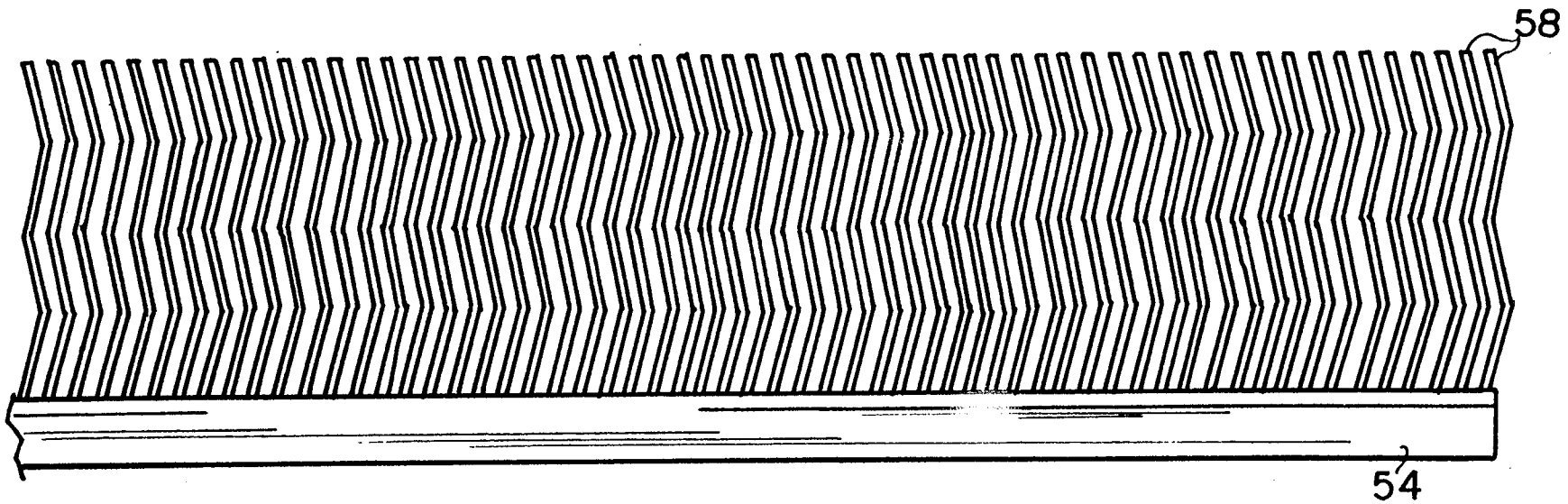
FIG. 4 is an enlarged top plan view portion of a comb-like element of the lower shaker deck.

FIG. 4 illustrates the zigzag-shaped finger 58 uniformly zigzag for the sizing and separation of material into four uniform lengths of about 3.25 inches (82.6 mm) each for a total length of 13 inches (330.2 mm) and having a diameter of 0.157 inches (4 mm) with a spacing of 0.197 to 0.354 inches (5 to 9 mm), or a diameter of 0.197 inches (5 mm) with a spacing of 0.393 to 0.748 inches (10 to 19 mm), of a wire diameter of 0.236 inches (6 mm) with a spacing of 0.787 to 1.57 inches (20 to 40 mm). As a rule thumb to describe the relationship between the aperture or parallel opening and angle of each bend in the rod, as the aperture increases, the angle must also increase to insure that the peak or top of a bend on an adjacent rod is at least parallel to the valley or bottom of a bend of adjacent rods in order to utilize the sizing ability or component of the zigzag rod.

In operation of the apparatus 10, material to be separated is dumped onto the surface of the upper deck 26. The upper and lower decks 26 and 28 are vibrated by rotary shaft 34 to impart a vertical movement to the free ends of the fingers 38 and 58. Material unable to pass the aperture between vibrating fingers 38 travels downwardly and is discharged outside of the apparatus 10 at the short end. Material which passes through the upper deck 26 falls on the surface of the lower deck where it is sized and separated by the vibrating zigzag fingers 58 of the lower deck 28 with coarse material traveling downwardly and discharged from opening 48 outside of apparatus 10, while finer material, i.e. not greater than the opening between the fingers 58 and sized, that is, not larger than for example 3.25 inches, passes through the lower deck 28 and accumulates within frame 12 or may be removed directly by a conveyor from the frame.

The apparatus and method as described and illustrated provide for the rapid, efficient sizing and separating by the upper deck and further separating and sizing by the lower deck of a material, which material may be quite diverse in its components and mixture.

What is claimed is:

1. A material separating apparatus to separate a solid, particulate-containing type feed material into a coarse material and a finer material, which separating apparatus comprises in combination:

a) a frame means having a one tall end and an other short end and sides joining the ends, the one end sufficiently high and sufficiently wide to permit the discharge within the frame of feed material from a soil carrying vehicle;

an upper vibratory screening deck means which comprises a screening means sloping downwardly from the one to the other end of said frame and adapted to separate feed material discharged thereon from the soil carrying vehicle into a coarse material which fails to pass through the screening means and which is discharged at the other short end of the frame and a finer material which passes through the screening means;

c) a lower vibratory screening deck means in a shingle arrangement, which means comprises a plurality of generally transverse, spaced apart bracket members having a plurality of spaced apart, small diameter rod elements having a one end and an other end, the rod elements secured at the one end to the transverse bracket member and having the other end free to vibrate in a generally vertical movement, the rod elements generally uniformly spaced apart in substantially the same plane, the free end of the rod elements extending slightly downwardly from the tall one end to the short other end of the frame extending over the adjacent lower transverse bracket member, the rod elements generally uniformly angled at defined uniform distances along the length of the rod element, the opening between the rod elements providing for separating, and the number and length of the angles in the rod elements providing for sizing the finer material falling from the upper screening deck means so as to permit the finer material to be separated from a coarse material which is discharged at the other short end of said frame and permitting the finer and sized material to pass through the angled rod elements; and d) means to vibrate both the upper screening and lower screening deck means and to permit the other free end of the angled rod elements to vibrate in a generally vertical plane, thereby providing for the sizing and separating of feed material into a coarse material and a finer material.

2. The apparatus of claim 1 wherein the rods elements are bent uniformly at an angle of from about 0° to 15° along the length of the rod element.

3. The apparatus of claim 1 wherein the small diameter rod elements are cylindrical and have a diameter of about 4 mm to 6 mm or less and an opening between the rod element ranging from about 5 mm to 40 mm.

4. The apparatus of claim 3 wherein the small diameter rod elements vary from about 6 to 18 inches (15.4 to 457.2 mm) in length and wherein the rod elements have about 3 to 7 transverse cross bar members from one to the other end of the frame.

5. The apparatus of claim 1 wherein the small diameter rod elements are angled at least three times from the one to the other end thereof.

6. The apparatus of claim 1 wherein the small diameter rod elements are non-removably secured in a C-type clamping transverse bracket.

7. The apparatus of claim 1 wherein the lower vibratory screening deck means is downwardly angled from the one to the other end at no angle of about 3° to 15°.

8. The apparatus of claim 1 which includes a portable, towable screening apparatus and includes:

a) wheel means at the one side of the frame and adapted for movement relative to the frame for road transport of the apparatus;

b) tow means at the other, opposite side of the frame for road transport of the apparatus by another vehicle;

c) upper downwardly angled side surface means about the frame to direct material to be separated onto the upper vibratory screening deck means; and d) motor means and an off center vibratory shaft secured to the upper and lower screening deck means to vibrate the said decks.

9. The apparatus of claim 1 which includes a generally vertical directing plate at the other short end of the frame, the upper end angled inwardly to receive coarse material from the upper screening deck means and the lower end angled downwardly to discharge coarse material outside of the apparatus, the directing plate spaced above the other end of the lower screening deck means to permit the discharge of the coarse material from the surface of the lower deck.

10. The apparatus of claim 1 wherein the upper screening deck means comprises a plurality of vibratory, large diameter transverse cross members and a plurality of rod elements having a one and an other end, the one end of the rod element secured to the transverse cross frame members, and the other end free to vibrate in a generally vertical movement, the transverse cross members and the rod elements extended in a shingle-type array from the one tall to the other short end of the frame and sloping slightly downwardly, the other free end of the rod elements extending over a transverse cross frame member of a lower transverse cross frame member and the rod elements being of greater diameter than the small diameter rod elements of the lower transverse frame and spaced apart a greater uniform distance than the uniform distance of the small diameter rod elements to provide for the separation of the feed material into a coarse material and a finer material.

11. The apparatus of claim 10 wherein the large diameter rod elements are cylindrical rod elements having a diameter of about one-quarter to one and one-half inches (6.4 to 38.1 mm) and are spaced apart about one-half to 8 inches (12.7 to 203.2 mm).

12. The apparatus of claim 10 wherein the large diameter rod elements are straight, cylindrical rod elements extending from about 12 to 36 inches (304.8 to 914.4 mm) in length.

13. The apparatus of claim 10 wherein the large diameter rod elements are individually, removably secured to the transverse bracket.

14. The apparatus of claim 10 which includes an upper material directing plate extending downwardly with one downward end of the directing plate over a transverse cross member at the tall end of the frame to direct feed material onto the upper surface of a first plurality of rod elements of the transverse cross member at the tall end of the frame.

15. A material separating apparatus to separate a fed material into a coarse material and a finer material, which separating apparatus comprises in combination:

a) a frame means having a one tall end and an other short end and sides joining the ends to support upper and lower vibratory screening decks, the one end sufficiently high and sufficiently wide to permit the discharge within the frame of feed material from a soil carrying vehicle;

b) an upper vibratory screening deck means which comprises a screening means sloping downwardly from the one to the other end of said frame and adapted to separate feed material discharged thereon from the soil carrying vehicle into a coarse material which fails to pass through the screening means and which is discharged at the other short end of the frame and a finer material which passes through the screening means and which comprises a plurality of transverse cross members and a plurality of vibratory, large diameter rod elements having a one and an other end, the one end of the rod elements secured to the transverse cross frame members, and the other end free to vibrate in a generally vertical movement, the transverse cross members and the rod elements extended in a shingle-type array from the one tall to the other short end of the frame and sloping slightly downwardly, the other free end of the rod elements extending over the transverse frame of a lower transverse frame, and the rod elements being of greater diameter than rod elements of the lower transverse frame and spaced apart a greater uniform distance than the uniform distance of the small diameter rod elements to provide for the separation of the feed material into a coarse material and a finer material;

c) a lower vibratory screening deck means in a shingle arrangement, which means comprises a plurality of generally transverse, spaced apart bracket members having a plurality of spaced apart, small diameter rod elements having a one end and an other end, the rod elements secured at the one end to the transverse bracket member and having the other end free to vibrate in a generally vertical movement, the rod elements generally uniformly spaced apart in substantially in the same plane, the free end of the rod elements extending slightly downwardly from the tall one end to the short other end of the frame extending over the next lower transverse frame member, the rod elements generally angled at defined uniform distances along the length of the rod element, the opening between the rod elements providing for separating, and the number and length of the angles in the rod elements providing for sizing the finer material falling on the upper surface of the rod element from the upper screening assembly so as to permit the finer material to be separated from a coarse material which is discharged at the other short end of said frame permitting the finer and sized material to pass through the angled rod elements;

d) means to vibrate both the upper screening and lower screening deck means and to permit the other free end of the angled rod elements to vibrate in a generally vertical plane, thereby providing for the sizing and separating of feed material into a coarse material and a finer material;

e) wheel means at the one side of the frame and adapted to movement relative to the frame for road transport of the apparatus;

f) tow means at the other, opposite end of the frame for road transport of the apparatus by another vehicle;

g) upper downwardly angled side surface means about the frame to direct material to be separated onto the upper vibratory screening deck means; and h) a motor means and an off center vibratory shaft secured to the upper and lower screening deck means to vibrate said deck means.

16. A method of separating and separating and sizing a solid, particulate-containing type feed material into a coarse material and a finer material, which method comprises:

a) discharging feed material to be separated onto the upper surface of an upper vibrating deck composed of a plurality of transverse upper brackets each having a plurality of downwardly sloping, large diameter, spaced apart rod elements secured at the one end to a bracket, the other free end of the rod element adapted to vibrate in a generally vertical direction, the upper brackets arranged in a shingle fashion so that the other free end of the rod elements extend downwardly and are the next adjacent, lower bracket to provide for the downward transport of feed material on the surface of the upper deck;

b) vibrating the large diameter rod elements of the upper deck to provide for the separation of the feed material in to a coarse material of defined size larger than the openings between the rod elements which is discharged from the surface of the upper deck and a finer material which passes through the larger diameter rod elements;

c) discharging the finer material passing through the upper deck onto the vibratory surface of a spaced apart lower deck, the lower deck composed of a plurality of transverse lower brackets, each having a plurality of downwardly sloping, small diameter, spaced apart rod elements secured at the one end to the lower bracket, the other free end adapted to vibrate in a generally vertical direction, the lower brackets arranged in a shingle fashion so that the other free end of the rod elements extend downwardly and over the next adjacent lower bracket to provide for the downward transport of the finer material, the rod elements uniformly slightly angled at defined lengths; and d) vibrating the small diameter rod elements of the lower deck to provide for the separation of the finer material discharged onto the surface of the lower deck based on the opening between the small diameter rod elements and the sizing based on the number and length of the angled positions of the small diameter rod elements to provide a finer separated and sized material which passes through the vibrating smaller diameter rod elements, and the discharge from the surface of the lower deck of the material which does not pass through the vibrating, angled, smaller diameter rod elements.

17. The method of claim 16 which includes clamping a plurality of the small diameter rod elements to each of the transverse lower brackets to permit the replacement of the entire transverse lower bracket on damage to one or more of the clamped rod elements.

18. The method of claim 16 which includes discharging feed material to be separated onto an upper material directing plate which extends downwardly over a first downwardly extending transverse upper bracket.

19. The method of claim 16 which includes discharging coarse material from the upper surface of the upper vibrating deck onto an upper curved section beneath the free end of the vibrating rods of the last bracket in the upper vibratory deck.

20. The method of claim 16 which includes angling the small diameter rod elements at an angle of up to about 15° and from three to four times along the length of the small diameter rod elements.

21. The method of claim 16 which discharging feed material to be separated and sized beneath the free end of the vibrating rods of the last bracket in the upper vibratory deck onto an upper vibratory deck with straight, vibrating rod elements and which feed material comprises solid particulate material, plastic sheet material and elongated stick material and slidably moving the plastic sheet material along the rod elements of the upper surface of the upper deck for discharge with the coarse material of the feed material, and sizing the stick material to be separated by the selection of the spacing and the angle of the rod elements of the lower deck and discharging the sized stick material with the fine material and discharging the large stick material from the upper surface of the lower deck with the coarse material.

22. The method of claim 16 wherein the feed material comprises solid, particulate-containing type feed material of varying size and length and comprises soil, rocks, water and domestic and residential solid trash materials.

* * * * *